US006619377B1

(12) United States Patent
Etay et al.

(10) Patent No.: US 6,619,377 B1
(45) Date of Patent: Sep. 16, 2003

(54) METHOD FOR VERTICAL CONTINUOUS CASTING OF METALS USING ELECTROMAGNETIC FIELDS AND CASTING INSTALLATION THEREFOR

(75) Inventors: Jacqueline Etay, Meylan (FR); Marcel Garnier, Uriage (FR); Yves Delannoy, Crolles (FR); Jean-Marie Galpin, Metz (FR); Jean-Yves Lamant, Marly (FR); Pascal Gardin, Metz (FR)

(73) Assignee: The Japan Research and Development Center for Metals, Tokyo (JP)

( * ) Notice: Subject to any disclaimer, the term of this patent is extended or adjusted under 35 U.S.C. 154(b) by 0 days.

(21) Appl. No.: 10/129,727

(22) PCT Filed: Nov. 17, 2000

(86) PCT No.: PCT/FR00/03191

§ 371 (c)(1),
(2), (4) Date: Aug. 13, 2002

(87) PCT Pub. No.: WO01/38022

PCT Pub. Date: May 31, 2001

(30) Foreign Application Priority Data

Nov. 25, 1999 (FR) ..... 99 14816

(51) Int. Cl.[7] ..... B22D 27/02; B22D 11/00
(52) U.S. Cl. ..... 164/466; 164/502
(58) Field of Search ..... 164/466, 467, 164/468, 502, 503, 504

(56) References Cited

U.S. PATENT DOCUMENTS 4,523,628 A * 6/1985 Vives ..... 164/468
RE32,529 E * 10/1987 Vives ..... 164/467

FOREIGN PATENT DOCUMENTS

| | | |
|---|---|---|
| DE | 35 17 733 | 11/1986 |
| EP | 0 100 289 | 2/1984 |
| EP | 0 916 434 | 5/1999 |

OTHER PUBLICATIONS

Vives C: "Effects of Force Electromagnetic Vibrations During the Solidifiction of Aluminum Alloys: Part II, Solidification in the Presence of Colinear Variable and Stationary Magnetic Fields", vol. 27B, No. 3, Jun. 1, 1996, pp. 457–464.

* cited by examiner

*Primary Examiner*—Kuang Y. Lin
(74) *Attorney, Agent, or Firm*—Sughrue Mion, PLLC

(57) ABSTRACT

The invention concerns a method which consists in: simultaneously subjecting the meniscus of the molten metal present in the ingot mould to the action of an axial alternating electromagnetic field tending to provide it with a general dome-like shape and to the action of a transverse direct electromagnetic field designed to attenuate the surface agitation of the meniscus. The implementing installation comprises an ingot mould (1) with cooled assembled plates (2, 3 and 4, 5) for casting metal slabs, an alternating current coil (17) enclosing the ingot mould at the meniscus (12) of the molten metal to produce an axial magnetic field, collinear with the casting axis (11), and a direct magnetic field winding passing through the large plates of the ingot mould at the meniscus (12) perpendicular to the casting axis.

9 Claims, 3 Drawing Sheets

METHOD FOR VERTICAL CONTINUOUS CASTING OF METALS USING ELECTROMAGNETIC FIELDS AND CASTING INSTALLATION THEREFOR

BACKGROUND OF THE INVENTION

The invention relates to the continuous casting of metals. More specifically, it relates to electromagnetic devices fitted into continuous casting molds and acting on the liquid metal present in said molds.

The use of electromagnetic fields to have an influence on the movements of the liquid steel in continuous casting molds of any format is in practice at the present time. The main objectives of imposing rotating electromagnetic fields (in the case of casting blooms and billets of square or slightly rectangular cross section) or traveling electromagnetic fields (in the case of casting slabs of rectangular cross section, the width of which is much larger than the thickness) are to homogenize the solidifying structures over the entire cross section of the product and to improve the surface finish of the product, together with its cleanliness from the standpoint of inclusions, especially near its surface. When casting slabs continuously, it is also known to impose static electromagnetic fields in the mold in order to stabilize the meniscus (i.e. the free surface of the molten metal in the top of the mold). This stabilization makes it possible to increase the product casting rate and therefore the productivity of the continuous caster. The electromagnetic devices producing this effect are known as "electromagnetic brakes".

The known uses of electromagnetic fields in continuous casting molds have, for the moment, not been sufficient to solve completely satisfactorily all the problems of cast product quality. Among these persistent problems, mention may be made of the following:

- the improvement in surface quality of the as-cast products, which corresponds to the reduction in the number of surface cracks and in the depth of oscillation ripples;
- the improvement in the subshell cleanliness of the cast product, which corresponds to a reduction in the size of the "solidification hooks" which form during oscillation of the mold, these hooks being potential sites for the trapping of inclusions and gas bubbles present within the liquid metal in the mold, and also to the elimination of inclusion pickup by the solidification front, benefiting from the effect of this front being "washed" by the liquid metal entrained by the electromagnetic stirring (the mechanisms relating to these problems will be described in detail below);
- the achievement of meniscus stability sufficient to guarantee optimum lubrication of the mold/solid metal interface by the covering slag which, in the liquid state, infiltrates therein so that this improved lubrication results in casting rates significantly greater than the usual rates.

Solving these problems satisfactorily would result in an increase in productivity of the caster and of the entire steel works. In addition to the increase in casting rate already mentioned, it would reduce the frequency of crack removal operations (in which the surface of the product is ground in order to eliminate defects therein) and would thus increase the proportion of products having a sufficient quality to be sent directly to the hot rolling mill. However, no currently known technique allows all the aforementioned qualitative objectives to be met simultaneously in an optimum fashion. In addition, the known techniques for achieving one or other of the these objectives are either expensive or require tricky implementation as they are very sensitive to the other casting conditions. Among these, apart from the methods mentioned above involving magnetic fields, mention may be made of systems which apply nonsinusoidal oscillations on the mold, embossed molds having a controlled hot-face roughness, covering slags of optimized composition, etc.

SUMMARY OF THE INVENTION

The object of the invention is to provide a process and a plant for the continuous casting of metals, which meet the productivity and quality objectives expected by operators of casters for continuously casting metals, especially steel.

With these objectives in mind, the subject of the invention is a process for the vertical continuous casting of metal products in a mold having cooled plates joined together, in which process the region of the meniscus of the liquid metal present in the mold is subjected to the action of an axial alternating magnetic field, collinear with the direction of casting, tending to impose on said meniscus a domed overall shape, characterized in that said region of the meniscus is also subjected to a continuous magnetic field directed transversely to the direction of casting in order to allow the shape of said meniscus to be stabilized.

The subject of the invention is also a plant for the vertical continuous casting of metals, comprising a mold having cooled plane plates joined together, of which two are long, facing one another in order to define a casting space, which plant is of the type having an electromagnetic coil supplied with AC current and surrounding the mold in the region of the meniscus of the liquid metal which is present therein so as to produce therein an alternating magnetic field directed along the casting axis, characterized in that it also includes an electromagnetic inductor which produces a continuous magnetic field passing through the long plates of the mold in the region of the meniscus perpendicular to the casting axis .

As will have been understood, the invention consists in creating at least two electromagnetic fields in the liquid metal present within the continuous casting mold, these fields acting simultaneously on said metal in the region of the meniscus. On of these fields is an axial alternating field and the other is a transverse continuous field, both being exerted in the region of the meniscus. They are produced by means of fitted inductors or inductors producing their effect near the meniscus.

Schematically speaking, the alternating field collinear with the casting axis is used to "dome" the meniscus, that is to say to define the convex dome shape that it naturally assumes on contact with the walls of the mold, while the transverse continuous field acts as an electromagnetic brake in order to reduce the local geometrical irregularities at the surface of this meniscus, resulting in subjacent convection currents generated by this alternating field.

Theoretically, applying a single alternating magnetic field might suffice by itself to obtain a smooth domed meniscus. This is because the electromagnetic force generated on the liquid metal has both:

- a confining surface component which tends to push the periphery of the meniscus away from the sides of the mold, and therefore to "hollow" it around the border, smoothing out its surface. This force is especially active at high frequency; and
- a stirring volume component which, because of the configuration of the convective currents in the liquid metal that it causes (annular stirring with the metal rising in the center of the mold), "swells" the central part of the meniscus. This force is, in contrast, especially active at low or medium frequency. Moreover, it is for this reason that it is the cause of surface instabilities. The maximum effect of this stirring force is obtained at a medium frequency, namely around 200 Hz to be specific, but in any case less than 500 Hz, whatever the nature or the thickness of the mold or the format of the metallurgical product cast.

It is these two conjugate actions—peripheral repulsion and stirring with central rising (which actions could be obtained from one and the same pulsating magnetic field—which give the meniscus a desired defined domed shape.

By the same token, but for the purpose of solidifying the electromagnetically confined metal, that is to say metal away from any physical contact with the cooled sides of the mold, it has already been proposed to create a magnetic environment within the mold, consisting of the superposition of two axial fields, that is to say both fields being directed along the casting axis, one being periodic (the confining field) and the other being constant in order to produce radial vibration forces in the confined liquid metal. These fields are generated by individual coils around the top of the mold, one being supplied with AC current at a frequency of between 500 and 5000 Hz, the other being supplied with DC current. To limit the stirring effect of the alternating field, it has either been proposed to add a third surrounding coil in order to create, at the point where the two previous fields already act, an additional periodic axial magnetic field at power frequency (EP-A-0 100 289 or the article by Ch. Virves, "Effects of forced electromagnetic vibrations during the solidification of aluminium alloys: Part II. *Solidification in the presence of collinear variable and stationary magnetic fields*" published in the journal Metallurgical and Materials Transactions B, Vol. 27B, No. 3, Jun. 1$^{st}$, 1996, pages 457 to 464). Again this type of teaching is found, for example, very briefly in this case, in document DE 35 17 733 (1986), which also proposes the use, beside a high-frequency variable axial confining magnetic field, of a continuous field which may be either axial or transverse, but which has to act over the entire height of the mold, thereby inevitably resulting in electromagnetic arrangements of extreme complexity from the technological standpoint.

That said, whatever the intended application—solidification with confinement or, like the present invention, geometrical control of the meniscus—the problem that arises is to be able to transfer enough electromagnetic energy through the copper mold into the cast metal. At the frequency levels adopted (greater than 500 Hz), it would in fact be necessary, because of the magnetic screening effect that the metal walls of the mold present, to segment it vertically in order to allow it to behave like an "electromagnetic cold crucible".

Such an arrangement is complex to put into practice both from the electromagnetic standpoint, because of the inevitable electrodynamic instabilities associated with the liquid nature of the final armature (the liquid metal within the mold) which is acted upon by the intermediate susceptor that the mold itself is, and also by the facte that the mold is above all a bottomless vertical crystallizer, the lateral sealing of which must always be perfect, the format of which must be geometrically stable (to avoid bulging phenomena in the long walls) and the cooling circuit of which is strictly optimized. Such a segmentation of the mold, in particular of the long side walls, would require having to completely reconsider an already proven design of the mold from the technological standpoint and from the functional standpoint.

In fact, because of its construction based on four copper or copper alloy plates joined together in the corners (two facing plane long walls and two short end walls), a slab mold naturally acts like a "cold crucible", but for moderate frequencies. At 200 Hz, most of the electromagnetic power delivered by an inductor can be transferred without any difficulty into the molten metal through the walls, the thickness of which rarely exceeds 40 or 45 mm. However, at this frequency, the meniscus deformation resulting, as explained above, from the combination of the confining force and the convection of the metal, results in large fluctuations over time in the "mean" shape of the meniscus. This is why, according to an essential feature of the invention, a continuous magnetic field is applied, directed perpendicular to the casting axis, which field, also applied in the meniscus region, will act as an electromagnetic brake on the subjacent liquid-metal convection currents generated by the centripetal force at 200 Hz doming the meniscus and will consequently have a smoothing effect on the meniscus surface.

The invention will be more clearly understood, and further aspects and advantages will become more clearly apparent, from reading the description which follows, for the purpose of exemplifying the invention, and with reference to the appended plates of drawings in which:

BRIEF DESCRIPTION OF THE DRAWING

In the figures, the same elements are denoted by identical reference numbers.

DETAILED DESCRIPTION OF TH DRAWING

Figure 1:
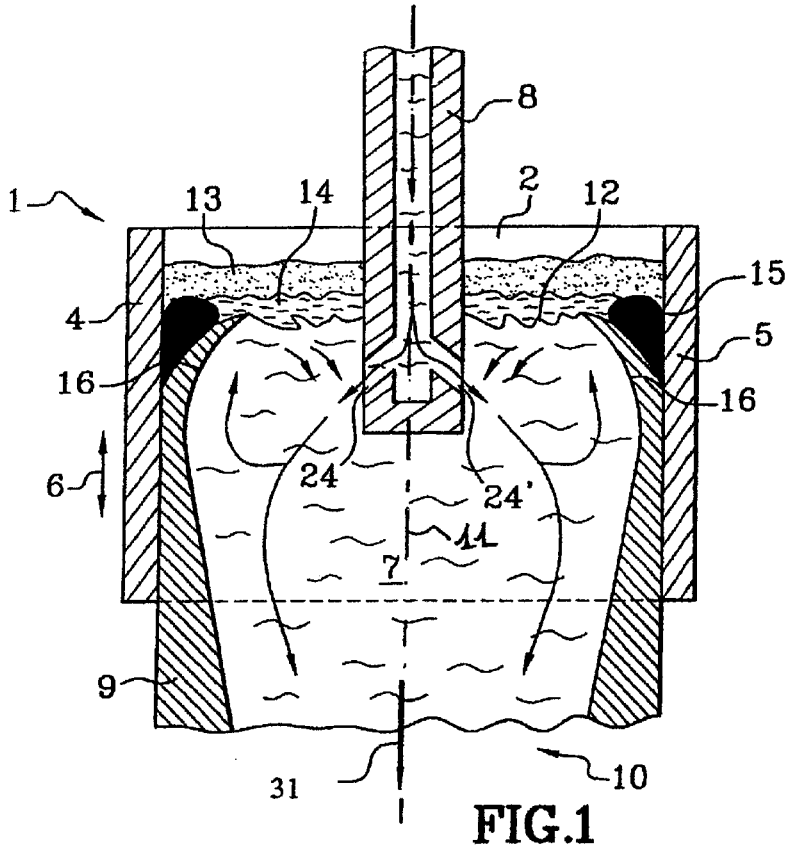
FIG.1 (prior art)
FIG. 1 shows schematically, seen in longitudinal section, a continuous steel-slab casting mold according to the prior art.

A conventional continuous slab casting mold 1 according to the prior art, shown schematically in FIG. 1, comprises four plane walls, made of copper or copper alloy, which are vigorously cooled by internal circulation of water, namely two facing long walls 2, 3—only one of which, 2, is visible in FIG. 1—and two short closure walls 4, 5 on the ends. For the sake of simplification, the means for internally cooling the walls 2, 3, 4, 5 of the mold 1 (generally a jacket defining vertical channels within which water is made to circulate) have not been shown.

The mold 1 is oriented vertically, thus defining a casting axis 11. During casting, it oscillates vertically with a small amplitude, as indicated by the arrow 6. The mold is fed with liquid steel 7 via a refractory nozzle 8 mounted in the bottom of a tundish (not shown) constituting a reservoir of liquid steel. The liquid steel 7 introduced into the mold 1 solidifies on the surfaces of the cooled long metal walls 2, 3 (and also on the short end walls 4, 5) in order to form a solidified shell 9. The thickness of the shell 9 progressively increases as the solidifying slab 10 is extracted via the open bottom of the mold 1 in the direction of the arrow 31 by known extraction means (not shown).

The free surface 12 (usually called the "meniscus") of the liquid steel 7 is covered with a cover slag essentially based on metal oxides, the slag having many functions, all useful to the casting operation. Firstly, it stops the thermal radiation emitted by the surface 12 of the liquid steel 7, and thus reduces its cooling. Above all, it ensures that the interface between the solidified shell 9 and the walls 2, 3, 4, 5 of the mold 1 are lubricated by the following mechanism. The cover slag in powder form is deposited on the surface 12 of the liquid steel 7. There it forms an upper layer 13 which remains in the solid state, while its lower layer 14, brought into contact with the molten steel 7, is in the liquid state, thereby allowing it to infiltrate between the solidified shell 9 and the walls of the mold. It is at this point that it acts as a lubricant. However, the presence should be noted of a slag bead 15, that is to say a band of cover slag which has solidified on contact with the cooled metal walls 2, 3, 4, 5. This slag bead 15 goes around the entire perimeter of the mold and may have a significant maximum thickness of about 10 to 20 mm.

The presence of the slag bead 15, coupled with the vertical oscillatory movements 6 of the mold, causes surface defects to appear on the slag 10 as it solidifies. The solidified shell 9 strikes the slag bead 15 during the ascending phases of the mold 1. It thus forms what is called a "solidification hook" 16, namely a curving-in of the upper end of the solidified shell 9 toward in the inside of the mold 1, as well as oscillation ripples of greater or lesser depth on the surface of the solidified cast product. This solidification hook 16 and the associated oscillation ripple are preferential sites for the formation of surface cracks and segregations, which degrade the quality of the final product, and for the trapping of nonmetallic inclusions and gas bubbles which rise along the solidification front of the lower regions of the liquid steel 7.

A known way of remedying these problems (cfe. the article entitled "Improvement of surface quality of steel by electromagnetic mold" by H. Nakata, M. Kokita, M. Morisita and K. Ayata in *Proceedings of the International Symposium on Electromagnetic Processing of Materials*, 1994, Nagoya) might consist of the imposition of an alternating electromagnetic field at a frequency of between 100 and 100000 Hz, preferably between 200 and 20000 Hz, by means of a multiturn coil wound around the mold 1 over its entire perimeter in the meniscus region and therefore generating an alternating magnetic field along the casting axis.

Figure 2:
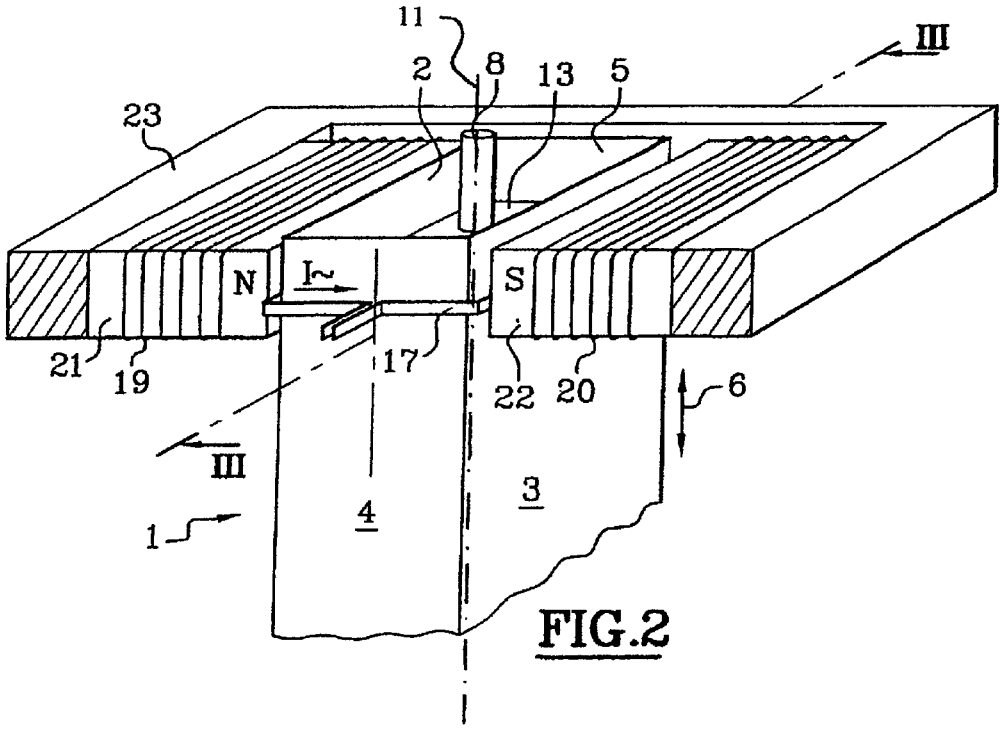
FIG. 2 shows schematically, in perspective, a continuous steel-slab casting mold according to the invention.
Figure 3:
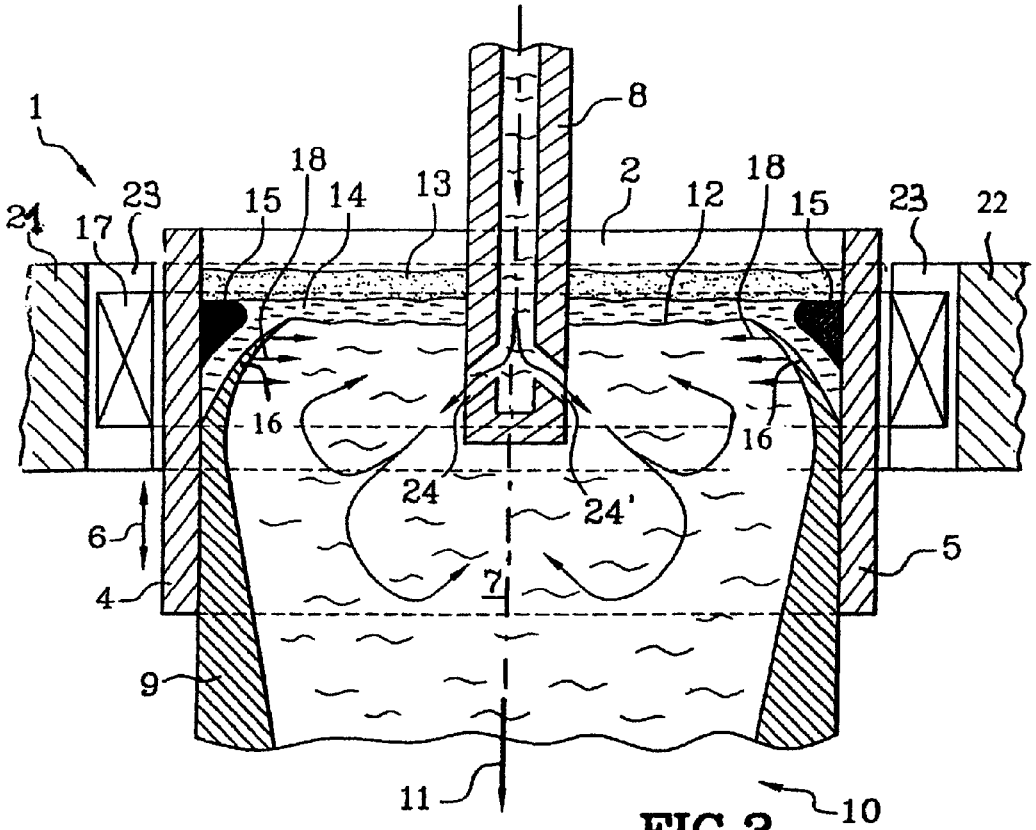
FIG. 3 shows schematically this same mold according to the invention seen in longitudinal section.

The device according to the invention, shown schematically in FIGS. 2 and 3, comprises such a coil 17 connected to a AC current generator (not shown) operating at a frequency lying within the aforementioned range. The electromagnetic field of the coil 17 generates induced currents in the liquid steel 7, especially in the region of the meniscus 12. As already indicated, the interactions between field and currents then generate an electromagnetic force whose effect at the wall of the mold is a centripetal effect 18 which hollows the periphery of the meniscus and the effect of which within the liquid metal 7 is a stirring effect which causes the center of the meniscus 12 to swell. The higher the frequency of the electromagnetic field, all other things being equal, the less the penetration of the field into the liquid steel 7, and therefore the greater the concentration of the electromagnetic forces (the intensity of which does not depend on the frequency of the current) in a restricted peripheral volume. This thus results, within the aforementioned frequency range, in confining forces 18 of sufficient intensity to repel the liquid steel 7, which is hollowed at this point and consequently ceases to be in contact with the slag bead 15.

The liquid steel 7 in the mold 1 thus has a surface 12 of pronounced dome shape. It therefore becomes possible, as shown in FIG. 3, to reduce, or even eliminate, the solidification hook 16 and also to reduce the thickness of the slag bead 15 since the temperature of its immediate environment is higher. Another consequence is that the molten cover slag 14 has a much greater possibility of infiltrating between the solidified shell 9 and the walls 2, 3, 4, 5 of the mold, which improves the lubrication and therefore allows higher casting rates than in the conventional technique. The level at which the liquid steel 7 starts to solidify in the mold is also more easily controlled and more stable, thereby helping to improve the surface finish of the slab 10. Finally, the effect of the pressure variations induced in the liquid cover slag 14 by the oscillations of the mold 1 on the upper part of the solidified shell 7 is reduced. In this way, the formation of solidification hooks is greatly reduced, causing the oscillation ripples on the surface of the slab 10 to be greatly reduced, or even eliminated. The characteristics of the coil 17 (its geometry, number of turns, total height and position with respect to the meniscus) and.the intensity of the current which flows therein are chosen so as to generate an electromagnetic field having an intensity of 500 to 3000 gauss near the walls of the mold in the meniscus region.

However, application of an alternating electromagnetic field, like that which has just been described, also has limitations and drawbacks. This alternating field, because of its repulsion and stirring effects on the metal in the meniscus region, causes perturbations in the surface of the meniscus, the frequency spectrum of which may be wide (from 0.05 Hz to several Hz) . The local agitation of the liquid steel by the rotational component of the alternating electromagnetic field may also contribute to this. In this case, entrainment of cover slag into the liquid steel 7 may occur, which degrades the cleanliness of the slab 10. The conditions under which the slab 10 can be cast also suffer, since lubrication takes place in an irregular manner. There may also be fluctuations in the line along which solidification in the mold first takes place, which then results in irregularities in the solidified thickness around the internal perimeter of the mold.

To remedy these problems, according to the invention, the alternating electromagnetic field collinear with the casting axis is superimposed on a continuous magnetic field oriented transversely to the direction of casting of the slab 10, going from one long wall 2 of the mold to the other 3, and also applied in the meniscus region. This continuous magnetic field has the effect of stabilizing the surface of the liquid steel 7 present in the mold 1, in this case the meniscus 12, by damping its vibrations. It also makes it possible to stabilize the position of the line of first solidification around the internal perimeter of the mold and, as a result, reduce the risk of slag being torn off due to the electromagnetic stirring, while still generating sufficient stirring intensity to ensure washing of the solidification front. Moreover, it slows down the circulation of liquid metal in the subjacent region of the meniscus, whether this circulation is due to the electromagnetic forces generated by the alternating field or stems from the jets of liquid metal emanating from the nozzle 8.

As shown in FIGS. 2 and 3, this transverse continuous magnetic field may be created by an electromagnet supplied with DC current by a generator (not shown). It consists of two coils 19, 20, having a common horizontal axis, facing each other on either side of the long sides 2, 3 of the mold, and each being wound around a pole piece 21, 22 made of a soft ferromagnetic material or of laminations of an iron-silicon alloy. The active face of the pole pieces 21, 22, which faces a long wall of the mold, is left free and positioned as close as possible to the latter. These active faces consist of a stack of iron-silicon alloy laminations bolted together, in the usual manner of producing magnetic poles for induction machines, and then rigidly attached to the body of the pole pieces. The rear part of the latter forms an integral part of a magnetic circuit, forming a yoke 23, which surrounds the mold and may even, where appropriate, consist of the frame of the caster. The coils are wound in the same sense so that the pole pieces 21, 22 have active magnetic faces with polarities of opposite sign. It should be noted that, in FIG. 2, that portion of the yoke 23 which surrounds the short wall 4 of the mold 1, closest to the observer, has been cut so as to reveal the coil 17. This design makes it possible to reduce the magnetic field losses, by channeling the lines of force and concentrating them in the pole pieces 21, 22, where the continuous electromagnetic field, of mainly horizontal direction, passes through the mold 1 and the liquid metal 7. The intensity of the magnetic field at the center of the mold will preferably be between 0.2 and 1 tesla over a height of about 100 to 200 mm in the meniscus region.

This magnetic yoke 23 may be made of a solid material so as to ensure that the rigidity and mechanical strength of the assembly are sufficient to support the pole pieces 21, 22. It will also be advantageous to provide interchangeable modular elements, also of laminated structure, intended to extend the active faces of the pole pieces 21 and 22. Such an arrangement will make it possible, on the base of an electromagnet of standard size, to be able systematically to minimize the gap separating it from the walls 2 and 3 of the mold, whatever the format of the product to be cast.

The continuous magnetic field thus created interacts with the velocity field in the liquid steel 7. Induced currents are created in the liquid metal 7, these being determined by the vector product of the velocity and of the magnetic induction. These induced currents in turn interact with the magnetic field which has given rise to them, in order to create an electromagnetic force—Laplace force—which here is a force braking the streams of liquid steel 7. In this way, the currents in the liquid steel 7 close to the meniscus, which are generated by the alternating electromagnetic field used to give the surface 12 of the liquid steel 7 its dome shape are greatly attenuated, which helps to stabilize the fluctuations in meniscus level. This is because the recirculations of liquid metal, which are due to the electromagnetic stirring and are located close to the walls of the mold in the convex portion of the meniscus 12, have velocity components perpendicular to the continuous magnetic field, allowing them to be effectively braked. In addition, as shown in FIG. 3, the nozzles 8 normally used in continuous steel slab casting have lateral outlets 24, 24' via which the molten steel penetrates the mold 1, which outlets are directed toward the short walls 4, 5 of the mold. When the liquid steel 7 has penetrated the mold it therefore has the main component of its velocity perpendicular to the transverse continuous magnetic field. This also produces a braking effect on this component with, as advantageous consequence, the fact that the steel feed jets emanating from the nozzle 8 do not go down so deep into the liquid well. This results in better homogeneity of the solidification structure of the slab 10, and also better cleanliness, since the nonmetallic inclusions are entrained to a shallower depth than -in the absence of a continuous electromagnetic field and therefore have a greater facility to settle on the surface and be trapped thereon by the cover slag 13. The effect of the solidification front being washed by the rising recirculation currents of liquid metal 7 is also reinforced. The absence of solidification hooks is also favourable to good subshell cleanliness. As regards the movements associated with the deformations of the liquid steel 7-cover slag 12, 13 interface, such as the standing or traveling waves which impair meniscus stability, these are also considerably reduced.

Figure 4:
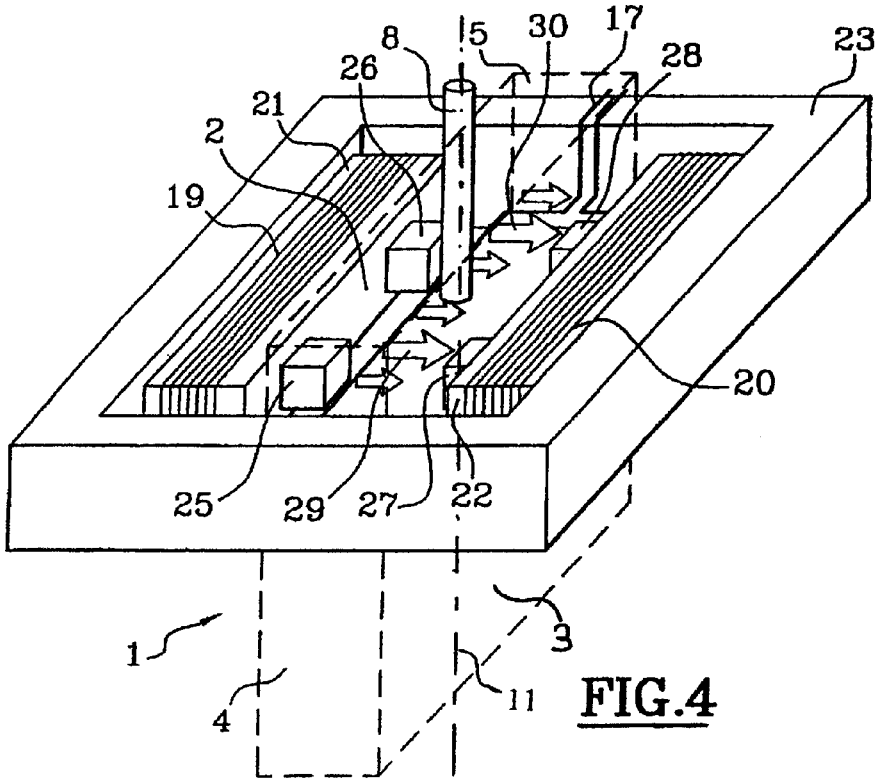
FIG. 4 shows schematically, in perspective, a first variant of the previous mold.

As already mentioned, the poles of the pieces 21, 22 are preferably formed by an assembly of metal laminations oriented vertically and separated by sheets of insulating material, in a manner comparable to that for making the cores of electrical transformers. If these poles are solid, the axial alternating magnetic field generated by the coil 17 can create induced currents therein, currents which heat the poles by the Joule effect, which may make it necessary for them to be cooled in contrast, a laminated structure ensures that they naturally remain at low temperature, without it being necessary to provide a forced cooling circuit. In addition, these induced currents may disturb the operation of the DC current generator supplying the coils 19, 20. However, it may be sufficient to limit this laminated construction to the poles 21, 22 and retain a yoke 23 made of a solid material which, as already mentioned, ensures that the assembly has the required strength and rigidity, The spatial distribution of the magnetic field depends on the geometry of the pole pieces 21, 22 and on the method of electrically connecting the coils 19, 20. FIG. 4 shows a variant of the invention, in which continuous magnetic field intensity gradients are created in the meniscus region. Such a configuration may sometimes be advantageous for removing certain traveling waves at the free surface 12 of the liquid steel 7. To obtain such gradients, the pole pieces 21, 22 around which the coils 19, 20 are wound may have, as shown, a crenellated shape. Thus, the pole piece 21 has two salient north poles 25, 26 and the pole piece 22 has two salient south poles 27, 28 placed so as to face the two north poles 25, 26. As the arrows 29, 30 symbolically indicate, it is between these salient poles 25, 27 and 26, 28 that the continuous magnetic field has the highest intensity. The position and the geometry of these salient poles 25, 26, 27, 28 are determined by the nature of the hydrodynamic perturbations to be eliminated, which themselves depend on the geometry of the cast product 10 and on the conditions under which the liquid metal 7 is fed into the mold 1.

In continuous slab casting, the distance between the long walls 2, 3 of the mold is usually about 200–300 mm, or even less in thin slab casting plants. It is therefore possible to create without any special difficulty a magnetic field whose effects are felt from one long wall 2, 3 to the other, and which also acts near the short walls 4, 5 if, as shown, the pole pieces 21, 22 extend over the entire width of the mold 1. On the other hand, to create a magnetic field which passes through the mold 1 from one short wall 4, 5 to the other would be more difficult and generally ineffective, since the distance between these short walls 4, 5 is from 1 to 2 m or more, and therefore they are very far apart. However, in the case of casting products of square or slightly rectangular cross section (blooms or billets), especially if they are large (for example having sides from 300 to 400 mm), it may be desirable to create two horizontal continuous magnetic fields, each perpendicular to two opposed sides of the mold, by means of electromagnets similar, for example, to those that have just been described. These two fields do not interact with each other, as each acts on a differently oriented component of the velocity of the liquid steel 7.

Figure 5:
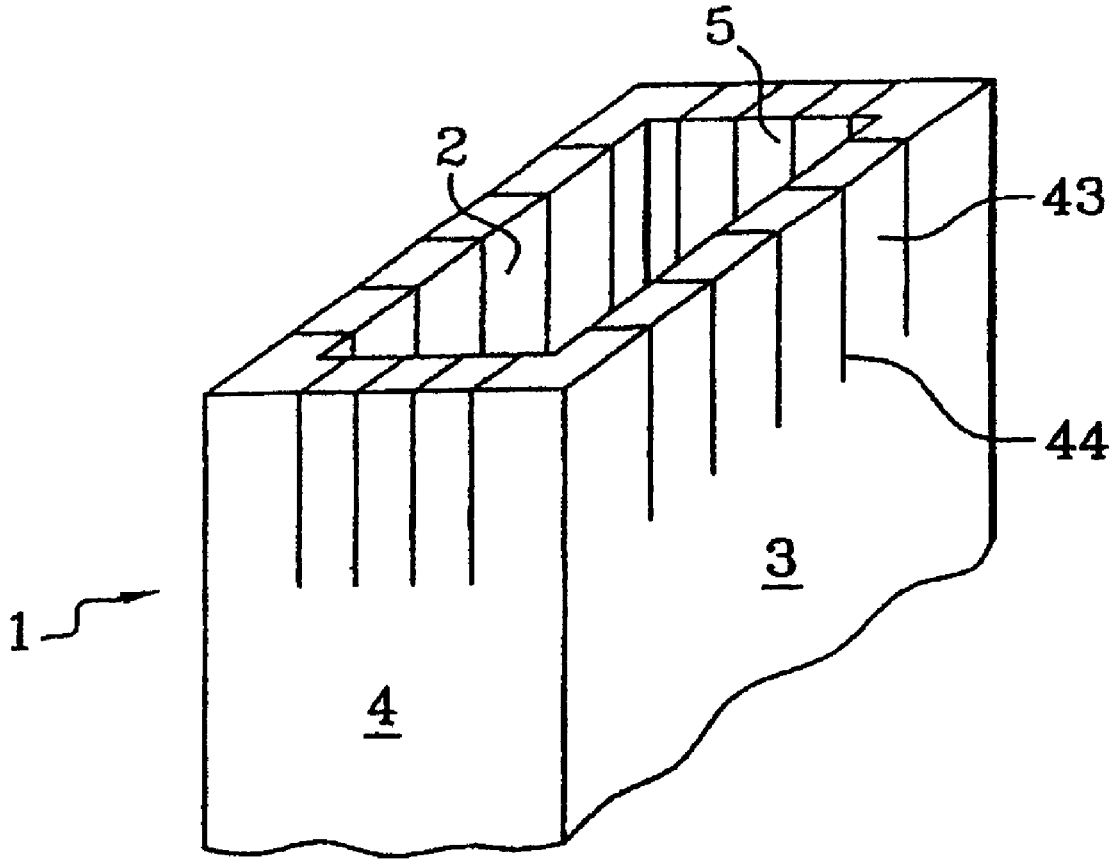
FIG. 5 shows a configuration of the mold making it highly permeable to the electromagnetic fields.

As shown in FIG. 5, it is possible, in a known manner already mentioned at the beginning, for the walls of the mold 1 to be vertically divided over at least that portion of its height which is subjected to said field, into a plurality of sectors 43 separated by an insulating grouting material 44, so as to counteract the self-induction effect of the mold itself with respect to the axial alternating magnetic field generated by the encircling coil 17 and thus improve the electrical efficiency of the plant.

As mentioned, the frequency of the AC current with which the coil 17 is fed, in order to create the axial alternating magnetic field, is normally between 100 and 100000Hz. In the low-frequency range (100 to 2000 Hz), it is possible to use "pulsed" AC currents, that is to say currents whose maximum intensity varies periodically between one phase having a maximum value and another having a minimum value, which may be zero. The phases during which the maximum intensity of the currents has a minimum value are used to damp the very-low-frequency perturbations which impair the stability of the surface 12 of the liquid steel 7 and the line of first solidification of the metal cast into the mold. In general, the pulsed current cycles follow one another at a frequency (called the "pulse frequency") of 1 to 15 Hz, preferably 5 to 10 Hz.

The effect of damping of the perturbations in meniscus level by the axial continuous magnetic field is ascribed to the combination of two actions:

- a braking action on the stirring flows generated by the rotational component of the electromagnetic forces due to the alternating field;
- a direct braking action on the angular velocity of the surface waves on the meniscus.

The numerical values that have been indicated are valid for application of the invention to the continuous casting of steel. However, the invention is of course applicable to the continuous casting of metals other than steel, when this casting is carried out on plants similar to those that have been described.

What is claimed is:

1. A process for the vertical continuous casting of metal products in an oscillating mold having cooled plates joined together, in which process the molten metal to be cast is cast by keeping it in contact with said oscillating cooled plates and the region of the meniscus of the liquid metal present in the mold is subjected to the action of an axial alternating magnetic field, collinear with the direction of casting, tending to impose on said meniscus a domed overall shape, characterized in that a magnetic field generated by an AC current pulsed at a frequency of less than 500 Hz is used and said region of the meniscus (12) is also subjected to a continuous magnetic field directed transversely to the direction of casting (11) in order to allow the shape of said meniscus (12) to be stabilized.

2. The process as claimed in claim 1, characterized in that said axial alternating electrical magnetic field is generated by a pulsed AC current with a pulse frequency of between 1 and 15 Hz, preferably between 5 and 10 Hz.

3. A plant for the vertical/continuous casting of metals, comprising an oscillating mold (1) having cooled plates (2, 3 and 4, 5) joined together, of which two (2, 3) are long, facing one another in order to define a casting space, in which the cast metal is brought into contact with said cooled plates which plant is of the type having an electromagnetic coil (17) supplied with AC current at a frequency of less than 500 Hz and surrounding the mold in the region of the meniscus (12) of the liquid metal which is present therein so as to produce therein an alternating magnetic field directed along the casting axis (11), characterized in that it also includes an electromagnetic inductor (19 to 23) which produces a continuous magnetic field passing through the long lates (2, 3) of the mold in the region of the meniscus (12) perpendicular to the casting axis.

4. The plant as claimed in claim 3, characterized in that said electromagnetic inductor is formed by at least one electromagnet supplied with DC current, consisting of two coils (19, 20), having a common horizontal axis, which are placed on either side of the mold (1), each coil being wound around a pole piece (21, 22) placed in the region of the meniscus (12) and forming an integral part of a yoke-forming magnetic circuit (23).

5. The plant as claimed in claim 4, characterized in that said pole pieces (21, 22) have a crenellated shape creating magnetic field intensity gradients.

6. The plant as claimed in claim 4, characterized in that said magnetic yoke (23) surrounds the mold (1).

7. The plant as claimed in claim 3, characterized in that it is divided, at least in its upper portion, into several vertical sectors (43) separated by an insulating material (44).

8. The plant as claimed in claim 4, characterized in that the pole pieces (21, 22) are made of laminations.

9. The plant as claimed in claim 4, characterized in that the pole pieces (21, 22) comprise interchangeable attached modular elements.

* * * * *